United States Patent [19]

Emory et al.

[11] Patent Number: 4,645,127

[45] Date of Patent: Feb. 24, 1987

[54] AIR ATOMIZING SPRAY NOZZLE

[75] Inventors: Lyle J. Emory, Darien; Patrick Maney, Villa Park, both of Ill.

[73] Assignee: Spraying Systems Co., Wheaton, Ill.

[21] Appl. No.: 646,562

[22] Filed: Aug. 31, 1984

[51] Int. Cl.[4] ..... B05B 7/08

[52] U.S. Cl. ..... 239/299; 239/424.5; 239/599; 239/600; 239/601

[58] Field of Search ..... 239/290, 296, 299, 300, 239/418, 424.5, 433, 600, 599, 601

[56] References Cited

U.S. PATENT DOCUMENTS

| | | | |
|---|---|---|---|
| 1,860,129 | 5/1932 | Binks et al. | 239/300 |
| 3,865,314 | 2/1975 | Levey et al. | 239/599 X |
| 3,952,955 | 4/1976 | Clements | 239/599 X |

FOREIGN PATENT DOCUMENTS

| | | | |
|---|---|---|---|
| 2702191 | 8/1978 | Fed. Rep. of Germany | 239/290 |

*Primary Examiner*—Andres Kashnikow

*Attorney, Agent, or Firm*—Leydig, Voit & Mayer, Ltd.

[57] ABSTRACT

An air atomizing spray nozzle for spraying a viscous liquid carrier at relatively low flow rates for agricultural and industrial applications. The nozzle comprises a hollow body with a liquid passage for receiving pressurized liquid from an external source, an air duct for receiving low pressure air from another external source, and a nozzle tip assembly. The latter includes a liquid spray tip connected to the liquid passage and having an elliptical discharge orifice formed by the intersection of a radiused end orifice bore and a cross slot communicating with the liquid passage; an air cap connected to the air duct and having a pair of diametrically opposed air nozzles straddling the liquid spray tip, each air nozzle having an outwardly diverging flat face with an oblong air orifice communicating with the air duct. Each air orifice is defined by the intersection of a radiused orifice bore and a cross slot in the flat face of the nozzle. The air nozzles are arranged with their cross slots parallel to the cross slot of the liquid spray tip and their air discharges impinge at an angle upon the discharge from the liquid spray tip to produce a relatively wide angle spray pattern of substantially uniform distribution and fine particle size.

8 Claims, 8 Drawing Figures

AIR ATOMIZING SPRAY NOZZLE

BACKGROUND OF THE INVENTION

The present invention relates generally to spray nozzles, and more particularly to air atomizing spray nozzles of the type which are especially useful in agricultural and industrial applications.

In the spraying of various chemicals, particularly in agriculture, the trend in recent years has been to use more viscous carriers, such as cottonseed oil or soybean oil, rather than water in order to minimize the quantity of carrier which must be transported to the treatment area. The higher cost of such viscous carriers has also made it desirable to minimize the volume of carrier liquid utilized in dispersing the chemicals.

Difficulties have been experienced in effectively spraying chemicals in oils or other viscous carriers. Such difficulties include the requirement for relatively high spraying pressures, lack of uniformity in particle size, and uneven distribution of particles with heavier concentrations of liquid at the outer edges of the spray pattern, resulting in waste of material due to the existence of an unduly concentrated spray pattern.

SUMMARY OF THE INVENTION

The general object of the present invention is to provide an air atomizing nozzle adapted to spray a viscous liquid carrier to define a relatively wide uniform spray pattern with a relatively low flow rate.

Another object of the invention is to provide a spray nozzle as characterized above wherein air discharges are coordinated with the viscous liquid spray to produce a relatively wide spray pattern of substantially uniform thickness and fine particle size.

A further object is to provide an air atomizing nozzle of the type set forth above wherein the spray pattern will be of substantially uniform thickness with its outer edges feathered to avoid excessive concentrations of liquid in those areas.

A further object of the invention is to provide an air atomizing spray nozzle of the foregoing character adapted to disperse economically a viscous liquid carrier in a uniform spray pattern without waste or uneven application of the spray.

Still another object of the invention is to provide an air atomizing nozzle of the type set forth above which will be of simple, economical construction and can be easily disassembled for cleaning and quickly reassembled for operation.

A further object is to provide an air atomizing nozzle as set forth above which may be utilized in agricultural applications with relatively inexpensive air pumps as the air supply source.

The foregoing objects are implemented in the spray nozzle of the present invention which comprises a hollow body; a nozzle tip assembly having a liquid spray tip with an elliptical orifice formed by the intersection of a radiused end orifice bore and a cross slot; an air cap defining a pair of diametrically opposed air nozzles on either side of the liquid spray tip, each air nozzle having an oblong orifice formed by the intersection of a radiused orifice bore and a cross slot parallel to the cross slot of the liquid spray tip; means for supplying carrier liquid to the spray tip; and means for supplying low pressure air to the air cap and air nozzles.

Figure 1:
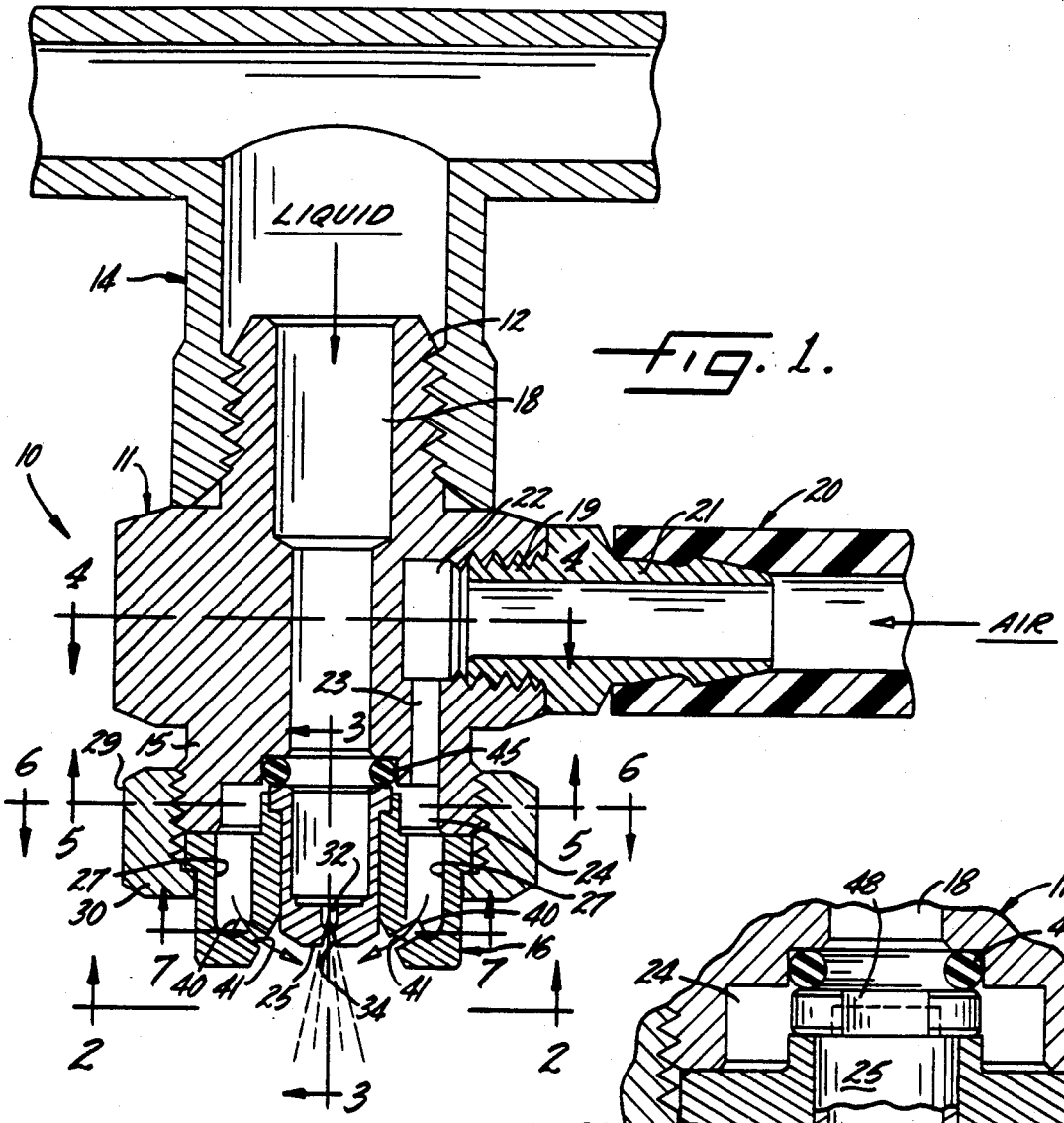
FIG. 1 is a vertical sectional view through an illustrative air atomizing spray nozzle exemplifying the present invention and connected to its respective sources of carrier liquid and low pressure air.
Figure 3:
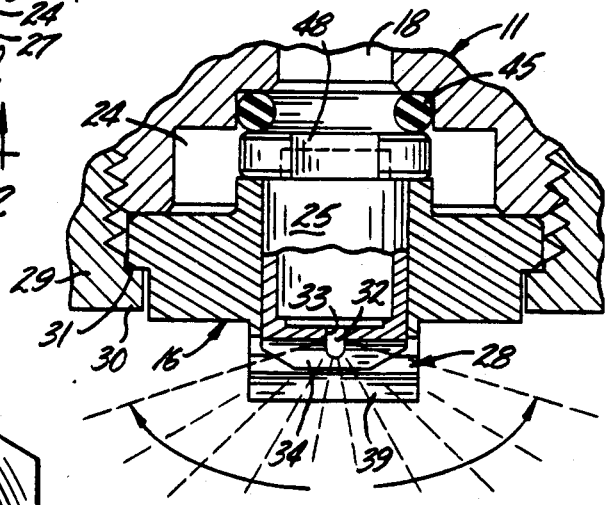
FIG. 3 is an enlarged, fragmentary vertical sectional view through the nozzle tip and air cap, taken in the plane of the line 3—3 in FIG. 1.
Figure 2:
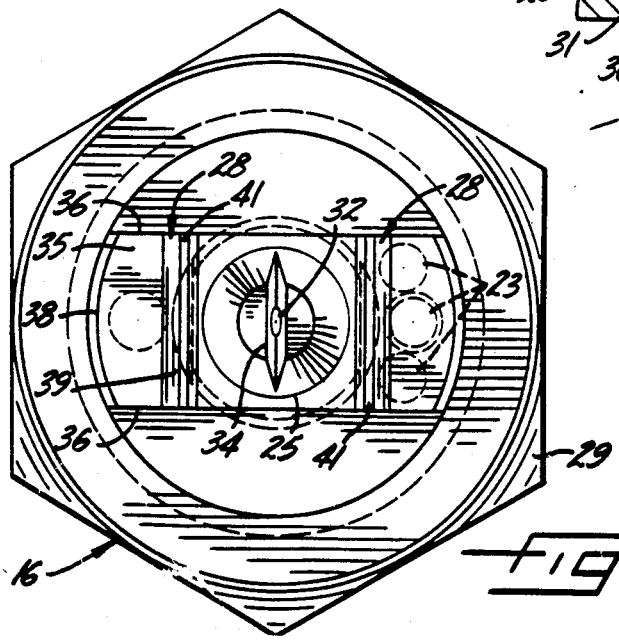
FIG. 2 is an elevational view of the discharge end of the nozzle, taken from the plane of the line 2—2 in FIG. 1.
Figure 4:
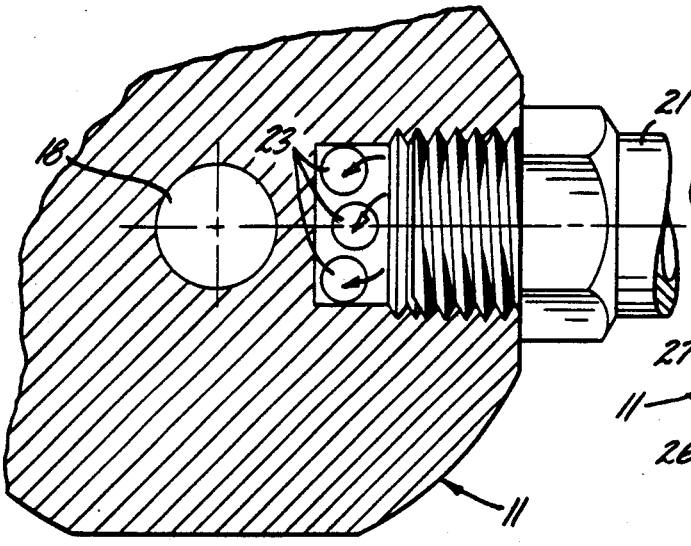
FIG. 4 is an enlarged, fragmentary, horizontal sectional view through the nozzle body taken in the plane of the line 4—4 in FIG. 1.
Figure 6:
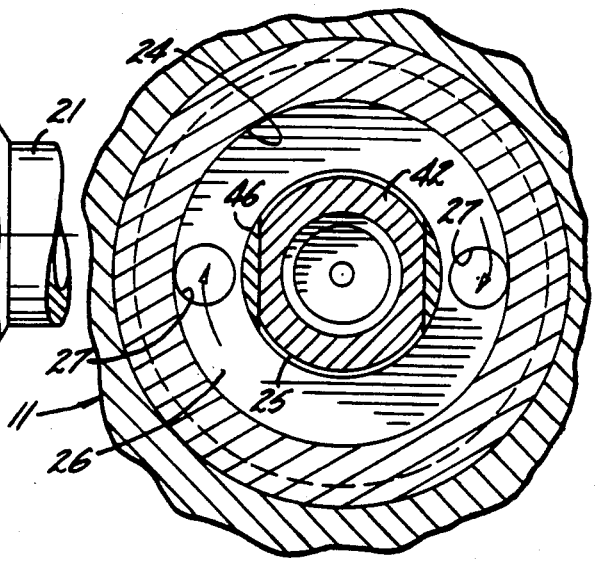
FIG. 6 is an enlarged fragmentary view also taken through the nozzle tip assembly and in the plane of the line 6—6 in FIG. 1.
Figure 5:
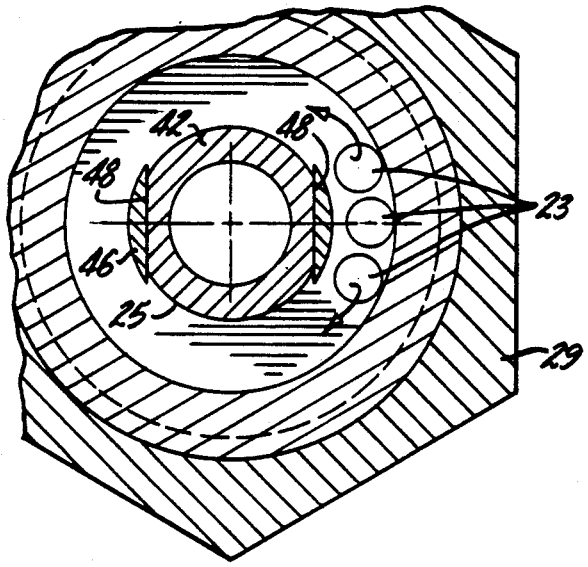
FIG. 5 is an enlarged, fragmentary, horizontal sectional view through the nozzle tip assembly taken in the plane of the line 5—5 in FIG. 1.
Figure 7:
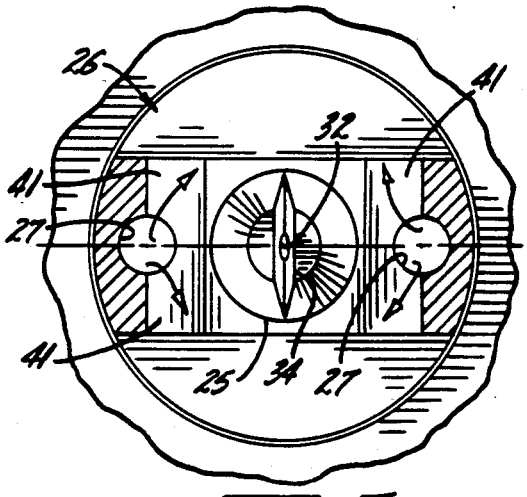
FIG. 7 is an enlarged, fragmentary sectional view through the air cap of the nozzle assembly, taken in the plane of the line 7—7 in FIG. 1.
Figure 8:
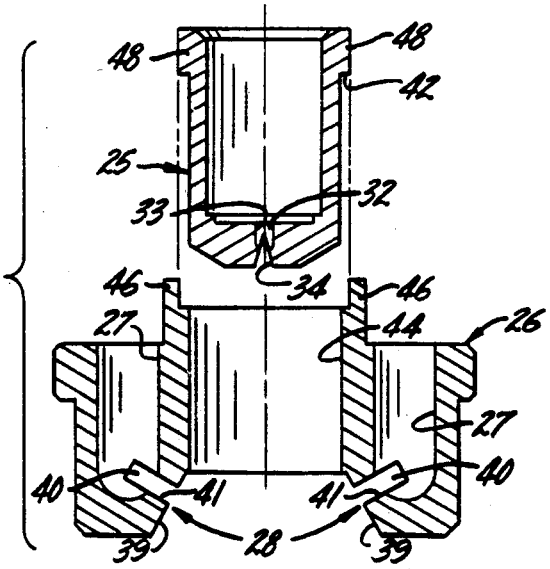
FIG. 8 is an enlarged, exploded, vertical sectional view taken axially through the nozzle tip and the air cap.

While the invention is susceptible of various modifications and alternative constructions, a certain preferred embodiment has been shown in the drawings and will be described below in detail. It should be understood, however, that there is no intention to limit the invention to the specific form described but, on the contrary, the intention is to cover all modifications, alternative constructions and equivalents falling within the spirit and scope of the invention.

DETAILED DESCRIPTION OF THE INVENTION

Referring more particularly to the drawings, there is shown in FIG. 1 an illustrative air assisted nozzle 10 embodying the present invention. The nozzle 10 includes a hollow body 11 having a first annular threaded hub 12 for attachment to a source 14 of pressurized liquid and a second annular threaded hub 15 which serves as a mounting for the nozzle tip assembly 16. A liquid passage 18 extends through the body and the first and second annular threaded hubs, connecting the pressurized liquid source 14 with the nozzle tip assembly.

The body 11 also has a third annular threaded hub 19 which in this case is connected to a source 20 of low pressure air by means of a hose shank 21. An air duct, consisting of an inner air chamber 22, a plurality of individual passages 23, and an outer air chamber 24 of annular form extends through the body 11 between the hub 19 and the nozzle tip assembly 16.

The nozzle tip assembly 16 comprises a nozzle tip 25 communicating with the liquid passage 18, and further comprises a surrounding air cap 26 in the form of a generally flat disc having a pair of air nozzles 28 fixed in diametrically opposed relation thereon. The nozzles 28 have air passages 27 defined by circular bores communicating with the air chambers 22, 24 and the passages 23 in the body 11. The assembly 16 is secured in place on the annular threaded hub 15 by means of a retainer collar or nut 29 having an in-turned flange 30 which engages a shoulder 31 on the air cap 26.

In accordance with the present invention, the nozzle tip assembly 16 is constructed and arranged so that the discharges of air nozzles 28 are coordinated with the viscous liquid spray discharge of nozzle tip 25 to produce a relatively wide angle spray pattern of substantially uniform thickness and fine particle size, such discharges having relatively low rates of flow. The nozzle tip 25 is accordingly fashioned with an elliptical discharge orifice 32 formed by the intersection of a radiused end orifice bore 33 and a cross slot 34 extending diametrically of the projecting end of the tip. The air nozzles 28 are situated in diametrically opposed relation on the air cap 26. Each nozzle 28 is of segmental form having a flat outer face 35, generally parallel sides 36, curved outer periphery 38 and inclined inner face 39 diverging from the longitudinal axis of the nozzle tip 25 by approximately 30 degrees. Each air nozzle 28 has a relatively large oblong orifice 40 defined in this instance by the intersection of an air passage 27 of circular cross section with a cross slot 41 in the inclined inner face 39 of nozzle 28. The cross slot 41 extends substantially perpendicular to the sides 36 of nozzle 28 and also to the inclined face 39 of the nozzle. Both air nozzles 28 are oriented with their cross slots parallel to each other and to the cross slot 34 adjacent the nozzle tip orifice 32. The angle of impingement is approximately 60 degrees from the longitudinal axis of the nozzle tip 25 and the impinging air streams include a substantial downstream component with regard to the discharged liquid spray.

The result of such interaction is to widen the angle of the liquid spray pattern to approximately 80 degrees while feathering the edges of the spray pattern to eliminate excessive spray distribution in those areas. This provides substantially uniform distribution of atomized liquid throughout the spray pattern. At the same time, atomization of the liquid into finer and more uniform droplet size is enhanced.

In accordance with a further aspect of the invention, the nozzle tip assembly 16 is constructed in a manner permitting quick disassembly and reassembly for cleaning, as well as ease of directional adjustment relative to the nozzle body. The nozzle tip 25 is fashioned in a hollow cylindrical form with a truncated conical outer end containing the liquid spray orifice 32 and cross slot 34. The inner end portion of the nozzle tip has a peripheral retaining flange 42. The nozzle tip is adapted to fit telescopically into a central bore 44 in the air cap 26 and is clamped by the air cap and retainer nut 29 against an O-ring liquid seal at the adjacent end of the liquid passage 18 (FIGS. 1–3 and 8).

To assure the maintenance of the parallel relationship between the elliptical discharge orifice 32 and its guide slot 34 with the guide slots 41 of the air nozzles 28, a precise indexing means is interposed between the air cap 26 and the nozzle tip 25 (FIGS. 1, 3, 5, 6 and 8). Such means comprises a pair of diametrically opposed segmental lugs 46 extending axially beyond the seat for the nozzle tip 25. The retaining flange 42 of the nozzle tip has a pair of diametrically opposed flats 48 which abuttingly engage the lugs 46 when the nozzle tip is assembled in place on the air cap. This arrangement maintains the parallel relationship between the cross slots of the air nozzles 28 and the nozzle tip 25.

Directional adjustment of the nozzle assembly 16 may readily be accomplished by loosening the retainer nut 29 and turning the air cap 26 manually on the body hub 15 until the nozzles 28 and tip 25 are aligned in the desired direction. Tightening of the nut 29 then secures them in that direction.

When a nozzle constructed as described herein is operated with no air pressure and an oil chemical mixture at 30 to 60 psi, the discharge angle of the liquid spray is approximately 30 degrees. When using the nozzle with air pressure less than 10 psi, the angle of the spray widens to about 80 degrees, the opposed edges of the spray pattern are feathered, and the spray particles are of finer and more uniform size. Typical spraying pressures for the nozzle are 30 to 60 psi liquid pressure and less than 10 psi air pressure.

In a typical agricultural spraying operation, the nozzles would be mounted at an 18 inch height above ground level and would be set on 20 inch centers with a spray pattern directed at an angle of about 80 degrees. The edges of each spray pattern are feathered, resulting in substantially uniform overlap distributions of adjacent sprays.

A further feature of the nozzle described above is that it permits the use of a relatively inexpensive air pump because of the low volume and pressures required in its operation. This is a decided advantage, particularly in agricultural applications.

We claim as our invention:

1. An air atomizing spray nozzle comprising, in combination, a hollow body, an annular hub on said body, means defining a liquid passage in said body for receiving pressurized liquid from an external source and conducting it to said annular hub, means defining an air duct in said body for receiving pressurized air from an external source and conducting it to said annular hub, a liquid spray tip mounted on said annular hub, said spray tip having an elongated discharge orifice in fluid communication with said liquid passage, an annular air cap having a central bore telescopically receiving said spray tip, a pair of diametrically opposed air nozzles on said annular air cap, each said air nozzle having an elongated discharge orifice in communication with said air duct for positioning in substantially parallel relation with and on opposites of the elongated discharge orifice of said spray tip, said spray tip having an outwardly projecting flange adjacent its upstream end, said air cap being formed with a shoulder for engaging said spray tip flange, a resilient sealing member interposed between the upstream end of said spray tip and said body, a retainer collar engageable with said air cap and said annular hub for urging said spray tip into engagement with said sealing member and into sealed liquid tight relation to said liquid passage in response to an axial force produced by said retainer collar, said spray tip discharge orifice being formed to discharge liquid longitudinally of said nozzle tip, said air cap discharge nozzles each being formed to each direct pressurized air at angles of about 60° to the longitudinal discharge of liquid from said spray tip to cause the discharging liquid to form a relatively wide liquid spray pattern of substantially uniform thickness and fine particle size, and indexing means between said liquid spray tip and said air cap for orienting the discharge orifice of the spray tip in parallel relation with the discharge orifices of said air cap and for permitting said spray tip and air cap to be adjusted in unison relative to said sealing member about the longitudinal axis of the spray tip without disturbing the parallel orientation of the spray tip and air cap discharge orifices.

2. The atomizing nozzle of claim 1, wherein said air nozzles are formed with opposed outwardly diverging faces each with a cross slot perpendicular thereto.

3. The atomizing nozzle of claim 2, wherein said air nozzles are formed with substantially parallel sides.

4. The atomizing nozzle of claim 1 wherein said indexing means includes a pair of diametrically opposed lugs on said air cap adapted for abutting engagement with a pair of diametrically opposed slats on said spray tip.

5. The atomizing nozzle of claim 1 in which said body has a second annular hub for attachment to said source of pressurized liquid and a third annular hub for coupling to said external source of pressurized air.

6. The atomizing nozzle of claim 5 in which said first and second annular hubs are in longitudinal alignment with said spray tip discharge orifice.

7. The atomizing nozzle of claim 6 in which said third annular hub is disposed in perpendicular relation to said first and second annular hubs.

8. The air atomizing nozzle of claim 1 in which said spray tip and air cap discharge nozzles each are formed by a radiused orifice bore and a cross slot communicating therewith.

* * * * *